US010507668B2

(12) United States Patent
Deng

(10) Patent No.: US 10,507,668 B2
(45) Date of Patent: Dec. 17, 2019

(54) PRINTING APPARATUS

(71) Applicant: Brother Kogyo Kabushiki Kaisha, Nagoya-shi, Aichi-ken (JP)

(72) Inventor: Yuanyuan Deng, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 16/135,173

(22) Filed: Sep. 19, 2018

(65) Prior Publication Data

US 2019/0299652 A1 Oct. 3, 2019

(30) Foreign Application Priority Data

Mar. 30, 2018 (JP) ..... 2018-066920

(51) Int. Cl.
*B41J 2/335* (2006.01)
*B41J 31/00* (2006.01)
*B41J 17/28* (2006.01)

(52) U.S. Cl.
CPC ..... *B41J 2/33505* (2013.01); *B41J 17/28* (2013.01); *B41J 31/00* (2013.01); *B41J 2202/31* (2013.01)

(58) Field of Classification Search
CPC ..... B41J 2/3352; B41J 2/32; B41J 2/33575; B41J 2/33515; B41J 25/304; B41J 25/312; B41J 25/316; B41J 25/308; B41J 25/3082; B41J 25/3084; B41J 25/3086; B41J 25/3088
See application file for complete search history.

(56) References Cited

U.S. PATENT DOCUMENTS 5,366,302 A * 11/1994 Masumura ..... B41J 25/316 347/197
6,061,076 A * 5/2000 Ishii ..... B41J 11/04 347/197
8,436,880 B2 * 5/2013 Matsushima ..... B41J 2/32 347/197
8,553,058 B2 * 10/2013 Huang ..... B41J 2/32 347/198

FOREIGN PATENT DOCUMENTS

JP 2002-264398 A 9/2002

* cited by examiner

*Primary Examiner* — Kristal Feggins
(74) *Attorney, Agent, or Firm* — Banner & Witcoff, Ltd.

(57) ABSTRACT

There is provided a printing apparatus including: a thermal head including heating elements arranged in a first direction; a shaft extending in a second direction; a first engaging part; a head holder; an insertion part; a shaft holder holding the shaft; a second engaging part engageable with the first engaging part so that the shaft does not come off from the shaft holder; a guide configured to guide the shaft holder movably between engaging and non-engaging positions; a fixing member; and a fixing member-holder. The fixing member fixes the shaft holder to the head holder in a case that the shaft holder is located at the engaging position. The fixing member-holder holds the fixing member so that the fixing member does not come off from the shaft holder in a case that the shaft holder is located at the non-engaging position.

5 Claims, 7 Drawing Sheets

PRINTING APPARATUS

CROSS REFERENCE TO RELATED APPLICATION

The present application claims priority from Japanese Patent Application No. 2018-066920 filed on Mar. 30, 2018 the disclosure of which is incorporated herein by reference in its entirety.

BACKGROUND

Field of the Invention

The present disclosure relates to a printing apparatus.

Description of the Related Art

In a printing apparatus of a thermal transfer type using a thermal head, it is preferred that pressing force is applied uniformly with respect to an ink ribbon in order to ensure the print quality. Conventionally, there is known a printing apparatus of the thermal transfer type which is provided with a thermal head, a head fixing member and a head self-aligning fulcrum shaft. The head fixing member is configured to fix the thermal head. The head self-aligning fulcrum shaft is attached to the head fixing member such that the head self-aligning fulcrum shaft is coincident with the center of gravity of the head fixing member. Further, the head self-aligning fulcrum shaft is pivotably or rotatably fixed to a chassis of the printing apparatus with a metal fixture.

In a case that the thermal head is used for a predetermined period of time, the thermal head is worn due to the friction with respect to an ink ribbon, etc., and needs to be replaced, in some cases. In order to replace the thermal head, the head self-aligning fulcrum shaft needs to be removed from the metal fixture. Accordingly, in a case that the metal fixture is fixed to the chassis with a fixing member, it is necessary to loosen the fixing member. If, however, the fixing member is loosened, there is such a fear that the fixing member might come off and fall into the inside of the printing apparatus. If the fixing member falls off into the inside of the printing apparatus, there is such a problem that the retrieval of the fixing member might be difficult.

An object of the present disclosure is to provide a printing apparatus configured to prevent a fixing member from coming off in a case that the thermal head is being replaced or exchanged.

SUMMARY

According to an aspect of the present disclosure, there is provided a printing apparatus including: a thermal head including a plurality of heating elements arranged in a first direction; a shaft provided on the thermal head, an axis line of the shaft extending in a second direction crossing the first direction; a first engaging part provided on the shaft member; a head holder configured to support the thermal head rotatably about the axis line of the shaft and detachably in the second direction; an insertion part provided on the head holding member, the shaft member being insertable into the insertion part rotatably about the axis line and detachably in the second direction; a shaft holder configured to hold the shaft; a second engaging part provided on the shaft holder and configured to engage with the first engaging part so that the shaft is rotatable about the axis line and that the shaft does not come off from the shaft holder; a guide configured to guide the shaft holder movably between an engaging position at which the first engaging part and the second engaging part engage with each other and a non-engaging position at which the first engaging part and the second engaging part do not engage with each other; a fixing member configured to fix the shaft holder to the head holder in a case that the shaft holder is located at the engaging position; and a fixing member-holder configured to hold the fixing member so that the fixing member does not come off from the shaft holder in a case that the shaft holder is located at the non-engaging position In the printing apparatus according to the aspect of the present disclosure, in a case that the second engaging part provided on the shaft holder is located at the engaging position at which the second engaging part engages with the first engaging part provided on the shaft, the fixing member fixes the shaft holder to the head holder. Accordingly, the shaft is not allowed to come off or fall off from the insertion part of the head holder, and thus the thermal head is held by the head holder. In a case that the thermal head is to be detached, the fixing by the fixing member is released, which in turn allows the shaft holder to be moved to the non-engaging position in the head holder. In a case that the shaft holder is moved to the non-engaging position, the fixing member-holder holds the fixing member so that the fixing member does not come off from the shaft holder. Accordingly, in a case that the thermal head is to be detached, it is possible to prevent the fixing member from coming off from the head holder.

DESCRIPTION OF THE EMBODIMENTS

In the following, an embodiment of the present disclosure will be explained with reference to the drawings. The following explanation will be given provided that a first direction and a second direction of a printing apparatus 1 are the front-rear direction and the left-right direction, respectively. The first direction and the second direction of the present embodiment are orthogonal to each other. In the left-right direction, a direction in which a thermal head 3 is arranged with respect to a head holding member 4 is referred to as a head holding direction.

Figure 1:
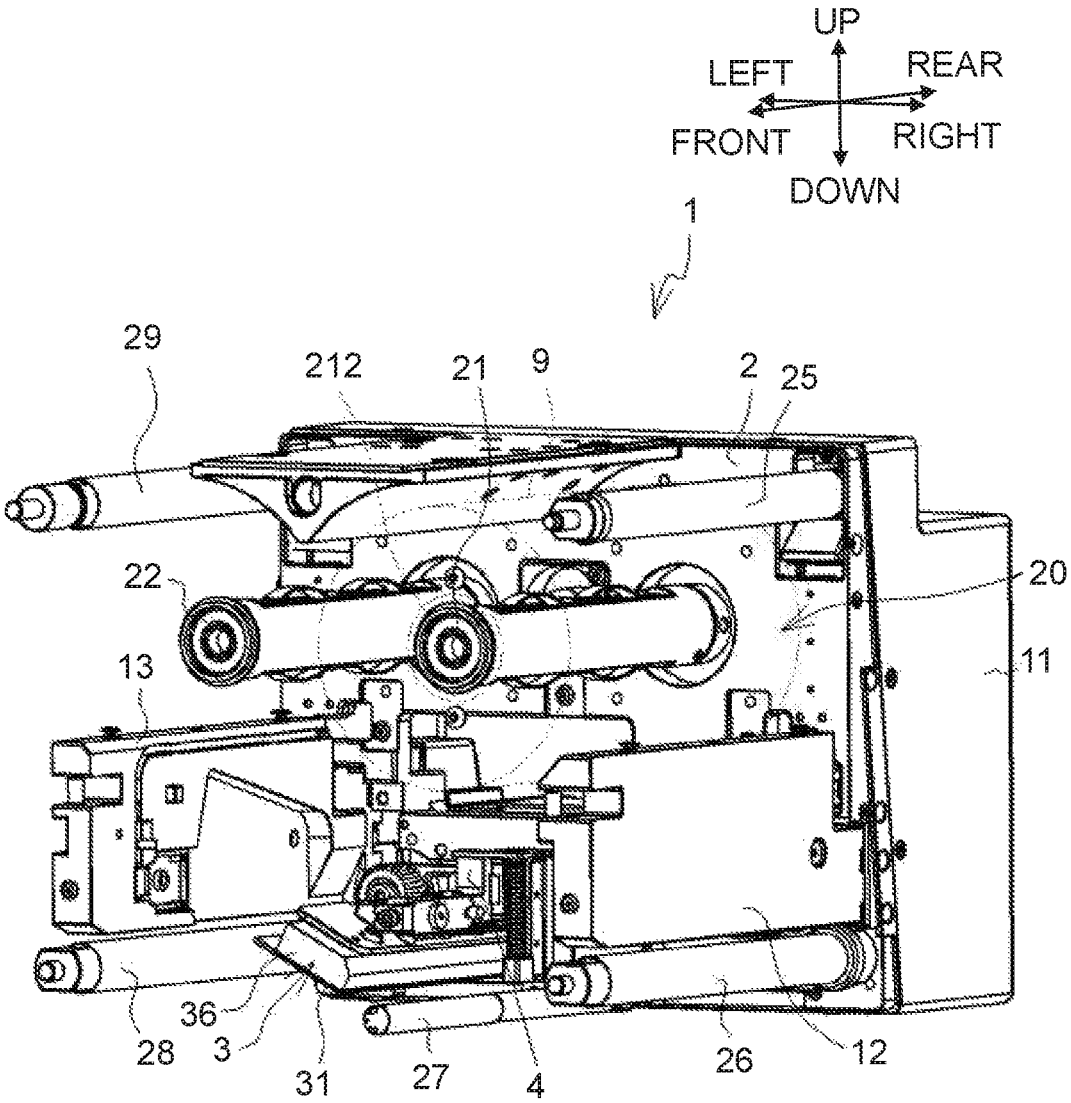
FIG. 1 is a perspective view of a printing apparatus 1.

A printing apparatus 1 depicted in FIG. 1 is a printing apparatus of the thermal-transfer type. The printing apparatus 1 is driven while being synchronized with a conveying apparatus for print medium which is configured to convey a print medium (not depicted in the drawings). The conveying apparatus for print medium conveys an elongated print medium (not depicted in the drawings) in the left-right direction at a predetermined conveying velocity. The print medium is, for example, a packaging material (wrapping material) which is formed to be a bag for containing foodstuffs therein. The printing apparatus 1 prints, for example, a letter text indicating a "best before date" on the print medium at a predetermined spacing distance.

As depicted in FIG. 1, the printing apparatus 1 is provided with a base 2, the thermal head 3, and the head holding member 4. The thermal head 3 is provided with a plurality of heating elements 31 arranged or aligned in the front-rear direction. The head holding member 4 is provided to be movable with respect to the base 2 in the up-down direction crossing both the front-rear direction and the left-right direction, and holds the thermal head 3 while causing the thermal head 3 to assume such a posture that the plurality of heating elements 31 are oriented in the front-rear direction. The printing apparatus 1 is further provided with a ribbon conveying mechanism 20, a moving assembly 30 (see FIG. 2), a second moving mechanism (not depicted in the drawings). The ribbon conveying mechanism 20 holds an ink ribbon 9 wound in a roll form and installed in a first installing part 21, and conveys the ink ribbon 9 in a predetermined conveyance direction. The moving assembly 30 moves the head holding member 4 in the up-down direction. The second moving mechanism moves the head holding member 4 in the left-right direction. In the following, respective parts, elements or components of the printing apparatus 1 will be explained in detail.

<Base 2>

The base 2 is a member supporting the respective constructive parts or elements provided on the printing apparatus 1 and including the thermal head 3 and the head holding member 4. The base 2 of the present embodiment is made of a rectangular metal plate. The printing apparatus 1 is provided with a cover 11. The cover 11 has a box-shape covering the back surface side of the base 2. The printing apparatus 1 is provided with a first pillar 12 and a second pillar 13. Each of the first and second pillars 12 and 13 has a plate shape extending frontward from the front surface of the base 2. The first pillar 12 is connected to a right end part of the base 2. The second pillar 13 is connected to a left end part of the base 2. The first pillar 12 and the second pillar 13 are separated and away from each other in the left-right direction and extend in parallel with each other.

<Ribbon Conveying Mechanism 20>

As depicted in FIG. 1, the ribbon conveying mechanism 20 of the printing apparatus 1 is provided with the first installing part 21, a second installing part 22, a first ribbon motor (not depicted in the drawings), a second ribbon motor (not depicted in the drawings), and guide shafts 25 to 29. Each of the first and second installing parts 21 and 22 is a shaft extending in the front-rear direction. The first and second installing parts 21 and 22 are rotatably supported on the front surface of the base 2. A first roll 212 is detachably installed in the first installing part 21 by inserting the first installing part 21 into a hole in a cylindrical-shaped core shaft of the first roll 212. A second roll (not depicted in the drawings) is detachably installed in the second installing part 22 by inserting the second installing part 22 into a hole in a cylindrical-shaped core shaft of the second roll. Namely, each of the first installing part 21 and the second installing part 22 is a spindle rotatably held in the base 2.

The ink ribbon 9 includes an ink layer and a base material (substrate), and has a strip-shape. The base material is formed, for example, of polyethylene terephthalate (PET). The ink layer includes, for example, a coloring component such as carbon, and a binder component such as wax and/or resin. The ink ribbon 9 is conveyed at a location below the thermal head 3 in such a posture that the ink layer is oriented toward (face) the print medium. The ink layer is melted by being heated, and is transferred onto the print medium. The ink ribbon 9 may have a functional layer or layers such as a back coat layer, a peel layer or a releasing layer, an adhesive layer, etc., as necessary. An end of the ink ribbon 9 is connected to the circumferential surface of the core shaft of the first roll, and the other end of the ink ribbon 9 is connected to the circumferential surface of the core shaft of the second roll.

Figure 2:
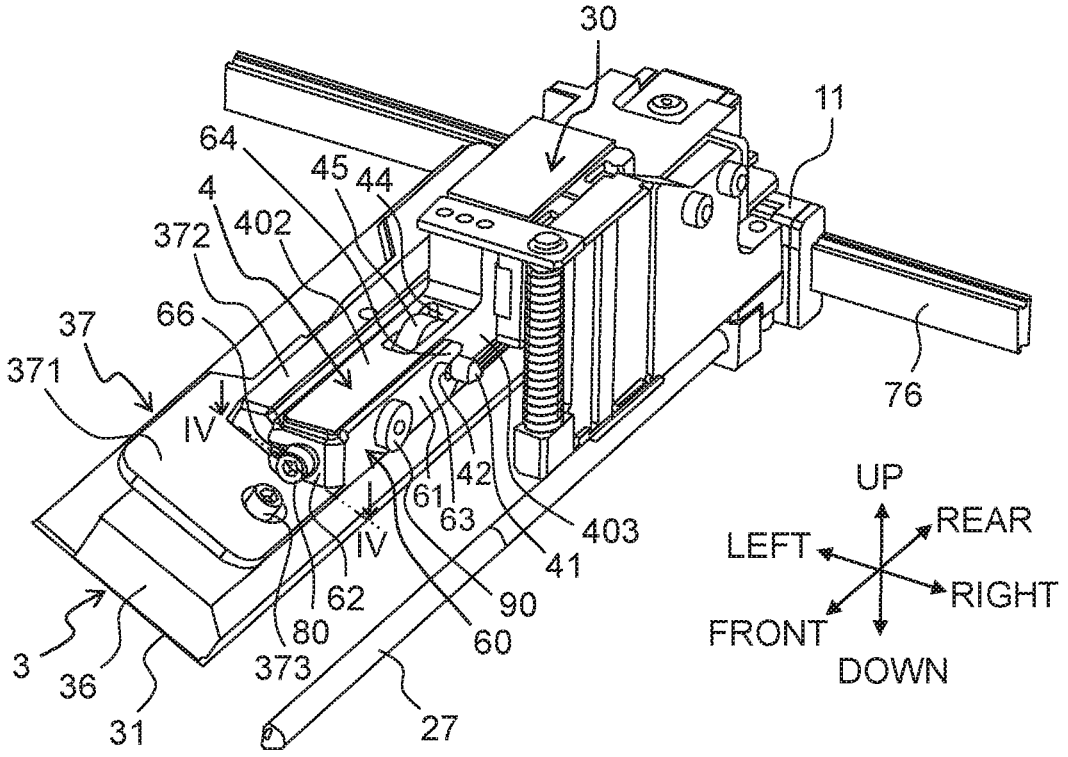
FIG. 2 is a perspective view of a thermal head 3 held by a head holding member 4.

The guide shafts 25 to 29 define a conveyance route or path of the ink ribbon 9. Each of the guide shafts 25 to 29 has a columnar shape; each of the guide shafts 25 to 29 is, for example, a roller rotatable about an axis of rotation extending in the front-rear direction. Each of the guide shafts 25, 26, 28 and 29 extends frontward from the front surface of the base 2, and a surface, of the ink ribbon 9, which is on the opposite side to the ink layer, makes contact with a part or portion of the circumferential surface of each of the guide shafts 25, 26, 28 and 29. As depicted in FIG. 2, the guide shaft 27 is detachably attached to a sliding member 77. The sliding member 77 is connected to a rear end part of the head holding member 4, and is held by a guide rail 76 to be silidably movable in the left-right direction with respect to the base 2. The guide rail 76 and the sliding member 77 face each other in the front-rear direction. It is allowable to use, for example, a commercially available linear guide as the sliding member 77 and the guide rail 76. In such a case, the sliding member 77 is a table attached to the guide rail 76. The guide shaft 27 extends frontward from the front surface of the sliding member 77, and a surface, of the ink ribbon 9, on the side of the ink layer 9, makes contact with a part or portion of the circumferential surface of the guide shaft 27. The ink ribbon 9 is conveyed while being guided by the respective guide shafts 25 to 29. The guide shaft 25 is arranged at a location in the vicinity of a right upper corner part of the base 2. The guide shaft 26 is arranged at a location in the vicinity of a right lower corner part of the base 2. The guide shaft 27 is arranged at a location in a lower and slightly leftward part from the center in the left-right direction of the base 2. The guide shaft 28 is arranged at a location in the vicinity of a left lower corner part of the base 2. The guide shaft 29 is arranged at a location in the vicinity of a left upper corner part of the base 2.

<Thermal Head 3>

Figure 3:
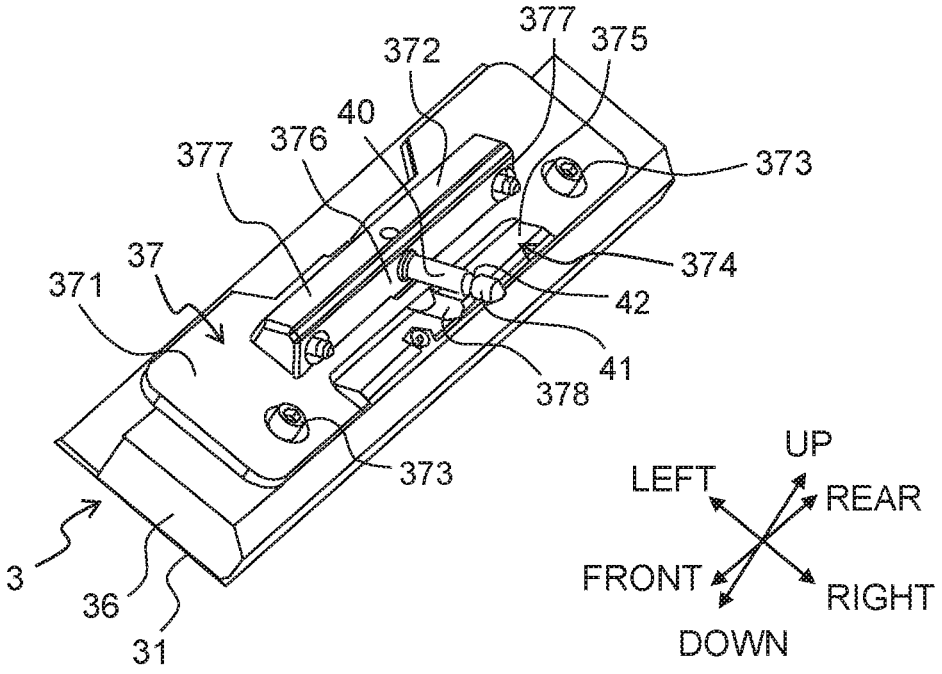
FIG. 3 is a perspective view of the thermal head 3 detached from the head holding member 4.

As depicted in FIG. 1, the thermal head 3 is arranged at a location in front of the front surface of the base 2 in the front-rear direction. The thermal head 3 is arranged at a location below the first installing part 21 and the second installing part 22. The thermal head 3 is a line thermal head provided with the plurality of heating elements 31 aligned in the first direction. More specifically, as depicted in FIGS. 2 and 3, the thermal head 3 has a configuration wherein a lower corner part of a plate-shaped ceramic substrate 36 which extends in the front-rear direction is chamfered, and a graze layer and the plurality of heating elements 31 are provided on the ceramic substrate 36. The plurality of heating elements 31 are arranged along an edge part, of the thermal head 3, extending in the front-rear direction while being oriented downward, namely oriented toward the other side in the up-down direction, of the thermal head 3.

As depicted in FIGS. 2 and 3, the thermal head 3 has an installing part 37 on the upper surface of the ceramic substrate 36. The upper surface of the ceramic substrate 36 is a surface, of the ceramic substrate 36, on the opposite side to the surface on which the plurality of heating elements 31 are provided. A front end of the installing part 37 is located on the rear side of a front end of the ceramic substrate 36. A rear end of the installing part 37 is located on the front side of a rear end of the ceramic substrate 36. The center in the front-rear direction of the ceramic substrate 36 is substantially coincident with the center in the front-rear direction of the installing part 37. The installing part 37 is provided with a first member 371, a second member 372 and a contacting member 374 (see FIG. 3). The first member 371 is a plate-shaped member making contact with the upper surface of the ceramic substrate 36 and extending in the front-rear direction. The first member 371 is fixed to the ceramic substrate 36 with screws 373, 373 provided on the sides of both end parts, respectively, in the front-rear direction of the first member 371.

The second member 372 is a member which is provided on a substantially central location in the left-right direction of the first member 371, extending in the front-rear direction, and having a cross section which is substantially a trapezoid. The length in the front-rear direction of the first member 371 is shorter than that of the ceramic substrate 36. Further, the length in the front-rear direction of the second member 372 is shorter than that of the first member 371. The second member 372 is provided with a right side surface 376 facing the head holding member 4, and a shaft member 40 provided on a substantially central part in the front-rear direction of the first side surface 376. The shaft member 40 is, as an example, a stick-shaped shaft extending in a direction orthogonal to the extending direction of the second member 372 (extending in the right direction in FIG. 3). The shaft member 40 has a groove 42 which is formed on a side of a forward end part 41 thereof and in the circumferential direction of the shaft member 40. The shaft member 40 is detachably inserted into an insertion part 401 (to be described later on) of the head holding member 4.

Further, the second member 372 is provided with a pair of elastic members 377 and 377 on the right side surface 376 facing the head holding member 4, with the shaft member 40 intervened between the elastic members 377 and 377. An example of each of the elastic members 377 is an O-ring made of rubber. The contacting member 374 is a columnar-shaped member which is provided on the side of a right end of the first member 371, which has a trapezoidal cross section and which extends in the front-rear direction. An inclined surface 375 of the contacting member 374 is inclined upwardly, and is brought into contact with end parts of a pair of urging members (not depicted in the drawings) built in the head holding member 4.

The thermal head 3 is provided with a curved surface 378 in the contacting member 374. In a case that the shaft member 40 is inserted into the insertion part 401 of the head holding member 4, the curved surface 378 is arranged at a position below the head holding member 4, and is curved in an arc form in the front-rear direction in accordance with the outer circumference of a rolling member 45 (to be described later on).

The thermal head 3 is adjacent to the conveyance path of the ink ribbon. In a case of performing printing by using the printing apparatus 1, the thermal head 3 is movable in the up-down direction by the moving assembly 30. In a case that the thermal head 3 is arranged at a printing position located at a lower end part in a movable range in the up-down direction of the thermal head 3, the thermal head 3 approaches closely to or makes contact with a platen (not depicted in the drawings) which is arranged at a position below the thermal head 3. The platen in the present embodiment has a flat-plate shape. In a case that, for example, the printing apparatus 1 performs printing without allowing the thermal head 3 to move in the left-right direction, the platen may be a roller-shaped platen. The platen faces the under side of the thermal head 3 which is arranged at the printing position. In response to the movement of the thermal head 3 to the printing position, the platen presses the print medium against the thermal head 3.

In a print-standby state, the thermal head 3 is arranged at a stand-by position. The stand-by position is a position at which a lower end part of the thermal head 3 is separated away from the platen, and makes contact with or approaches closely to the ink ribbon extending in the left-right direction. The stand-by position is set to be a position which is located below the upper end of the moving range in the up-down direction of the thermal head 3 and at which the thermal head 3 is separated away from the ink ribbon. In the present embodiment, the position at which the thermal head 3 is separated away from the ink ribbon is a position at which the lower end of the thermal head 3 is located above a line connecting the lower ends of the guides shafts 26 and 28 namely a part or portion of the conveyance path between the guide shafts 26 and 28. The printing position is a position at which the lower end of the thermal head 3 makes contact with the platen in a state that the print medium is not arranged between the thermal head 3 and the platen. In a case that the print medium is arranged between the thermal head 3 and the platen, the thermal head 3 arranged at the printing position makes contact with the platen with the ink ribbon and the printing medium intervened between the thermal head 3 and the platen. In a case that the thermal head 3 is arranged at the printing position, the conveyance path of the ink ribbon is changed by the thermal head 3. Specifically, the conveyance path of the ink ribbon is changed between the guide shaft 26 and the guide shaft 28 from that in a case in which the thermal head 3 is arranged at the stand-by position.

<Head Holding Member 4>

Figure 4:
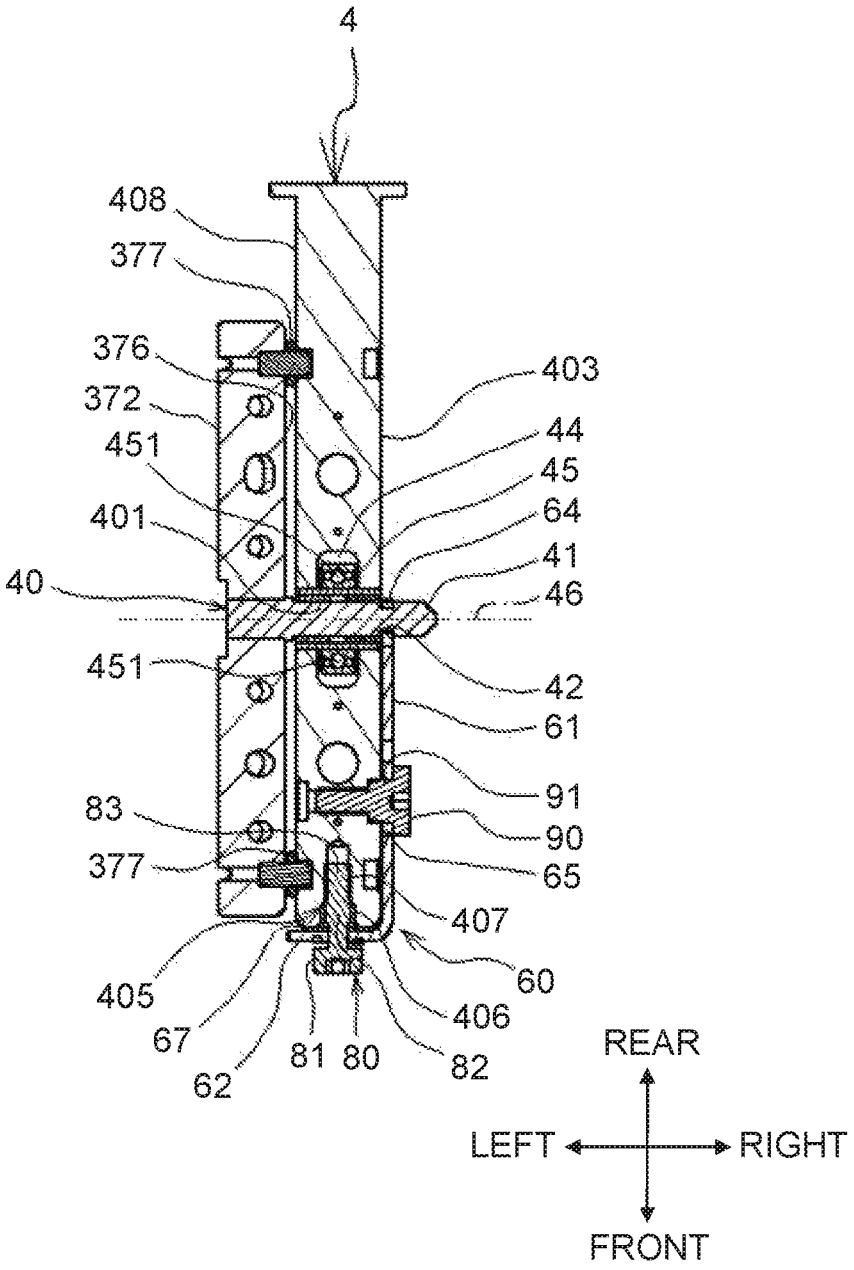
FIG. 4 is a cross-sectional view of the head holding member 4, a shaft holding member 60 and a shaft member 40 taken along a line IV-IV depicted in FIG. 2 and as seen from the direction of arrows in FIG. 2.
Figure 6:
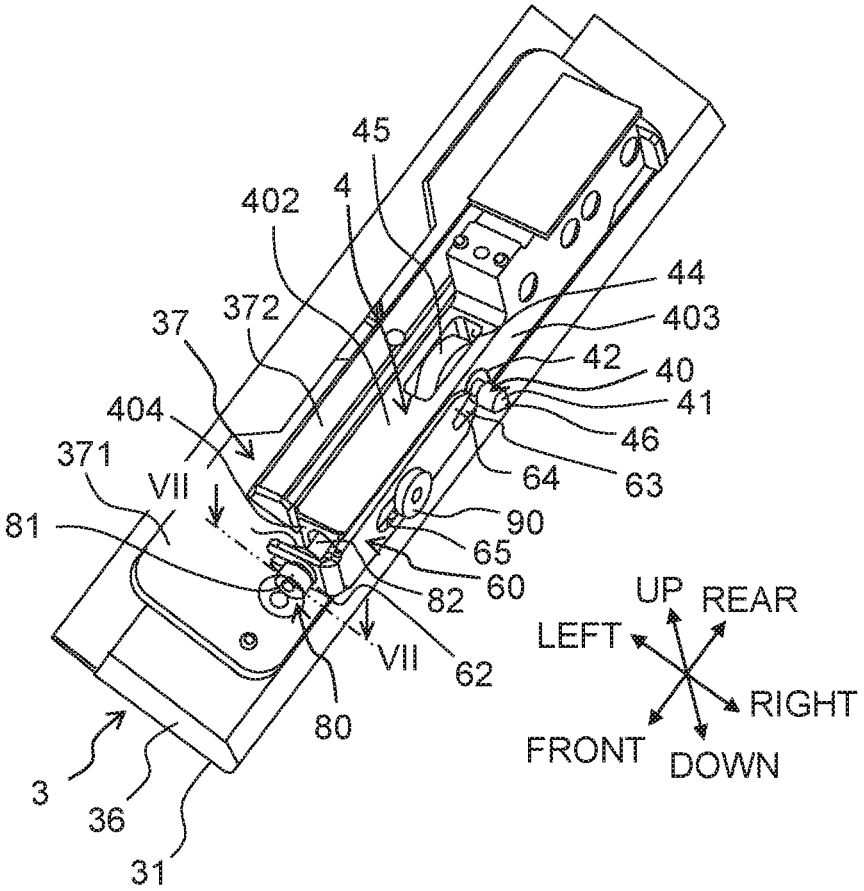
FIG. 6 is a perspective view depicting a case in which the shaft holding member 60 is at a non-engaging position.

As depicted in FIGS. 2, 4 and 6, the head holding member 4 is a member having a quadrangular-prismed shape which is long in the front-rear direction, and is provided with an upper surface 402, a right side surface 403, a front surface 404 (see FIG. 6), a left side surface 408 (see FIG. 4), a bottom surface (not depicted in the drawings), and a rear surface (not depicted in the drawings). As depicted in FIG. 4, the head holding member 4 is provided with an insertion part 401 which is a hole penetrating through the head holding member 4 in the left-right direction. The insertion part 401 allows the shaft member 40 to be inserted therein such that the shaft member 40 is rotatable about an axis line 46 (see FIG. 4) and that the shaft member 40 is attachable and detachable in the left-right direction. The side surface shape of the insertion part 401 is circular. The insertion part 401 allows the shaft member 40 to be detachably inserted thereinto. The insertion part 401 is provided at a central part in the front-rear direction of the thermal head 3. The central part in the front-rear direction of the thermal head 3 is a part including the center of gravity in the front-rear direction of the thermal head 3. The shaft member 40 is inserted into the insertion part 401 to be rotatable such that the thermal head 3 is rotatable, with respect to the base 2, about the axis line 46 extending in the left-right direction. The front surface 404 is provided with an insertion hole 405 into which a screw 80 (to be described later on) as an example of a fixing member is insertable.

As depicted in FIGS. 2, 4 and 6, the head holding member 4 has a hole 44 which is open upwardly and which is provided on a substantially central part in the front-rear direction of the head holding member 4. A rolling member 45 is inserted into the hole 44 and is held by the head holding member 4 to be rotatable about the axis line 46 as the center of rotation. Into the rolling member 45 of this embodiment, the shaft member 40 is inserted, which in turn allows the rolling member 45 to be held by the head holding member 4 such that the rolling member 45 is rotatable about the axis line 46 as the center of rotation. An upper end part of the rolling member 45 projects upward and above the upper surface 402 of the head holding member 4. It is allowable that the upper end part of the rolling member 45 projects upward and above the upper surface of the head holding member 4, or that the upper end part of the rolling member 45 does not project upward and above the upper surface of the head holding member 4. The rolling member 45 makes contact with a lower surface of a head pressing member (not depicted in the drawings), and is pressed downward by the head pressing member. The hole 44 of the present embodiment is open also downwardly. Namely, the hole 44 of the present embodiment penetrates through the head holding member 4 in the up-down direction. A lower end part of the rolling member 45 projects downward and below the lower surface (not depicted in the drawings) of the head holding member 4. It is allowable that the lower end part of the rolling member 45 projects downward and below the lower surface of the head holding member 4, or that the lower end part of the rolling member 45 does not project downward and below the lower surface of the head holding member 4. In a case that the shaft member 40 is inserted into the insertion part 401, the curved surface 378 of the contacting member 374 receives the rolling member 45 from therebelow. The length in the left-right direction of the curved surface 378 is longer than the length in the left-right direction of the rolling member 45. In a case that the rolling member 45 is pressed downward by the head pressing member, the pressing force from the head pressing member is transmitted to the plurality of heating elements 31 via the curved surface 378. As depicted in FIG. 4, a bearing 451 is provided in the inside of the rolling member 45.

<Shaft Holding Member 60>

Figure 5:
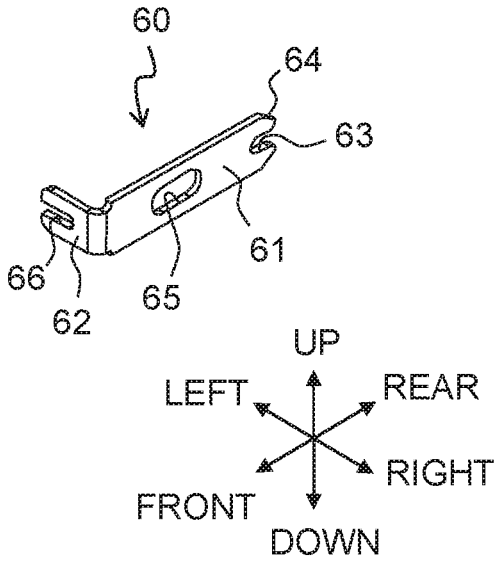
FIG. 5 is a perspective view of the shaft holding member 60.
Figure 7:
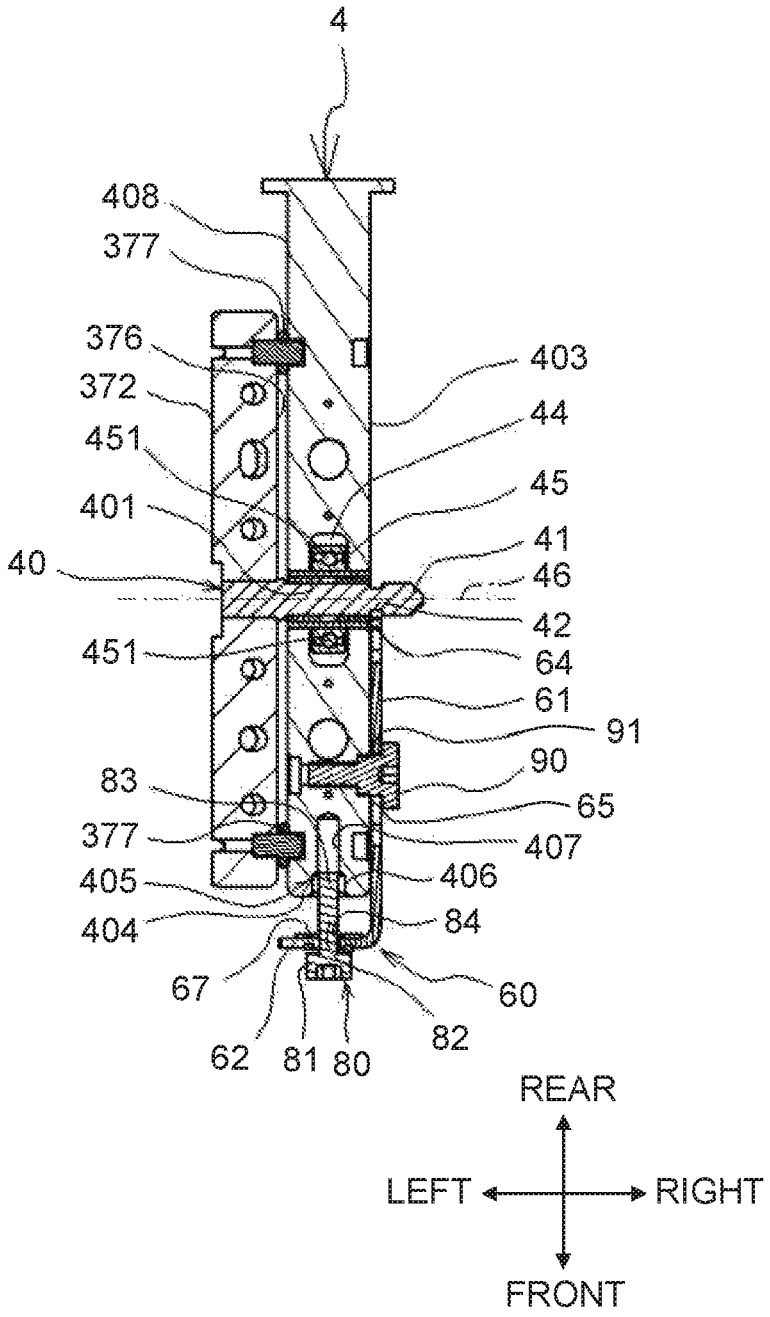
FIG. 7 is a cross-sectional view of the head holding member 4, the shaft holding member 60 and the shaft member 40 taken along a line VII-VII depicted in FIG. 6 and as seen from the direction of arrows in FIG. 6.

As depicted in FIGS. 2, 4 and 6, the head holding member 4 is provided with a shaft holding member 60. As depicted in FIG. 5, the shaft holding member 60 is a plate-shaped member which is bent in a substantially L-shape as seen in the up-down direction, and is provided with a first side plate 61 and a second side plate 62. The first side plate 61 extends in the front-rear direction with a predetermined width in the up-down direction; the second side plate 62 extends in the left-right direction orthogonal to the first side surface 61, with a predetermined width in the up-down direction. As depicted in FIGS. 2, 4 and 6, in a case that the shaft holding member 60 is attached to the head holding member 4, the first side plate 61 is parallel to the right side surface 403 of the head holing member 4, and the second side plate 62 is parallel to the front surface 404 of the head holding member 4. A long hole 65 is formed in the first side plate 61 at a substantially central part in the front-rear direction of the first side plate 61 such that the long hole 65 is located closer, to some extent, to the front side of the first side plate 61. The long hole 65 is oblong extending in the front-rear direction. As depicted in FIG. 4, a stepped part 91 of a stepped screw 90 fixed to the head holding member 4 is inserted into the long hole 65 to thereby guide the shaft holding member 60 to be movable in the front-rear direction. As depicted in FIGS. 2 and 4, a position at which the shaft holding member 60 is moved to the rear side with respect to the head holding member 4 is referred to as an "engaging position"; as depicted in FIGS. 6 and 7, a position at which the shaft holding member 60 is moved to the front side with respect to the head holding member 4 is referred to as a "non-engaging position". The shaft holding member 60 is movable between the engaging portion and the non-engaging position.

Further, as depicted in FIG. 5, in the shaft holding member 60, an insertion part 64 having a U-shaped cutout 63 is formed in the first side plate 61 at an end portion on the rear side thereof. Further, the second side plate 62 is formed with a U-shaped cutout 66 opened in the left direction. As depicted in FIGS. 2, 4 and 6, the screw 80 is inserted into the cutout 66. As depicted in FIGS. 4 and 7, the screw 80 is provided with a head part 81, a cylindrical part 82 extended from the head part 81, and a screw part 83 formed on a side of an end portion of the cylindrical part 82. Furthermore, a washer 67 is provided on the cylindrical part 82 at a location on the side of the head part 81. The washer 67 is fitted to a groove part 84 which is provided on the cylindrical part 82 of the screw 80, at a location on the side of the head part 81, and prevents the screw 80 from coming off from the shaft holding member 60 at the non-engaging position.

Moreover, the insertion hole 405 of the head holding member 4 is provided with a hole 406 of which inner diameter is greater than the diameter of the screw part 83 of the screw 80, and a screw hole 407 which is formed in the hole 406 on the side of an end portion thereof and which is configured to be screwed to the screw part 83. The length in the front-rear direction of the hole 406 is longer than the length in the front-rear direction of the screw hole 407. Further, the inner diameter of the hole 407 is greater than the outer (external) shape of the screw part 83.

As depicted in FIG. 4, in the engaging position, the cutout 63 of the insertion part 64 is inserted into the groove 42 of the shaft member 40. Namely, the insertion part 64 is inserted into the groove 42 to thereby fix the shaft member 40 to the head holding member 4. In this situation, there is a gap in the up-down direction between the groove 42 and the cutout 63 of the insertion part 64. Further, the second side plate 62 of the shaft holding member 60 is fixed, with the screw 80, to the front surface 404 of the head holding member 4. Accordingly, the shaft holding member 60 does not move from the engaged position. Thus, the thermal head 3 is fixed to the head holding member 4.

<Detachment of Thermal Head 3>

In a case that the printing operation is continued for a predetermined period of time, the heating elements 31 are worn and the thermal head 3 needs to be replaced, in some cases. An explanation will be given about the detachment of the thermal head 3. Firstly, a user loosens the screw 80 fixing the shaft holding member 60 to the head holding member 4 with a tool, and pulls the screw part 83 from the screw hole 407. The screw 80 moves in the front direction, and the screw part 83 moves to the hole 406. Next, as depicted in FIGS. 6 and 7, the user moves the shaft holding member 60 in the front direction with respect to the head holding member 4, to thereby move the shaft holding member 60 to the non-engaging position. In this situation, the cutout 63 of the insertion part 64 of the shaft holding member 60 is separated and away from the groove 42 of the shaft member 40. Further, the stepped part 91 of the stepped screw 90 makes contact with the rear end part of the long hole 65, thereby preventing any further frontward movement of the shaft holding member 60. Furthermore, since the washer 67 is fitted to the groove part 84 which is provided on the cylindrical part 82 of the screw 80 at a location on the side of the head part 81, it is possible to prevent the screw 80 from coming off from the shaft holding member 60 at the non-engaging position. Next, the user pulls the shaft member 40 from the insertion part 401 of the head holding member 4 so as to move the thermal head 3 in a direction separating from the head holding member 4, thereby making it possible to detach the thermal head 3 from the head holding member 4. The user detaches a harness (not depicted in the drawings) from the thermal head 3 so that the thermal head 3 can be replaced or exchanged.

<Attachment of Thermal Head 3>

Next, an explanation will be given about the attachment of the thermal head 3. The user inserts the shaft member 40 of the thermal head 3 depicted in FIG. 3 into the insertion part 401 of the head holding member 4, as depicted in FIGS. 6 and 7. In this case also, since the washer 67 is fitted to the groove part 84 which is provided on the cylindrical part 82 of the screw 80, at the location on the side of the head part 81, it is possible to prevent the screw 80 from coming off from the shaft holding member 60. Next, as depicted in FIGS. 2 and 4, the user moves the shaft holding member 60 rearwardly with respect to the head holding member 4 to thereby move the shaft holding member 60 to the engaging position. In this situation, the cutout 63 of the insertion part 64 of the shaft holding member 60 is fitted to the groove 42 of the shaft member 40. Further, the rear surface of the second side plate 62 makes contact with the front surface 404 (see FIG. 6) of the head holding member 4. Next, the user tightens, with a tool, the screw 80 to thereby fix the shaft holding member 60 to the head holding member 4. At this time, as depicted in FIG. 4, the pair of elastic members 377 and 377 are interposed between the left side surface 408 of the head holding member 4 and the right side surface 376 of the second member 372, urging the left side surface 408 and the right side surface 376 in a direction away from each other. Next, the user attaches the harness (not depicted in the drawings) to the thermal head 3.

In the printing apparatus 1, in a case that the insertion part 64 of the shaft holding member 60 is arranged at the engaging position at which the insertion part 64 is engaged with the groove 42 of the shaft member 40, the screw 80 fixes the shaft holding member 60 to the head holding member 4. Accordingly, the thermal head 3 is held by the head holding member 4, without allowing the shaft member 40 to come off from the insertion part 401 of the head holding member 4. In a case that the thermal head 3 is to be detached, the fixing by the screw 80 is released, which in turn allows the shaft holding member 60 to be moved to the non-engaging position with respect to the head holding member 4. In a case that the shaft holding member 60 is arranged at the non-engaging position, the washer 67 makes contact with the rear surface of the second side plate 62 of the shaft holding member 60 to thereby hold the screw 80 so that the screw 80 does not come off from the shaft holding member 60. Accordingly, in a case that the thermal head 3 is to be detached, it is possible to prevent the screw 80 from coming off from the head holding member 4.

Further, at the engaging position at which the groove 42 of the shaft member 40 is inserted into the cutoff 63 of the insertion part 64, there is a gap in the up-down direction between the groove 42 and the cutout 63 of the insertion part 64. Accordingly, the resistance with respect to the rotation about the axis line 46 of the shaft member 40 does not become great, which in turn realizes a smooth rotation.

The screw 80 is provided with the head part 81, the cylindrical part 82 extended from the head part 81, and the screw part 83 formed on the side of the end portion of the cylindrical part 82. Further, the head holding member 4 is provided with the insertion hole 405 into which the screw 80 is insertable; and the insertion hole 405 is provided with the hole 406 of which inner diameter is greater than the diameter of the screw part 83, and the screw hole 407 which is formed in the hole 406 on the side of the end portion thereof and which is configured to be screwed to the screw part 83. Accordingly, even in such a case that the screw 80 is turned excessively in a direction for loosening the screw 80 and that the screw part 83 is apart from the hole 407, the screw 80 does not project further frontwardly, thereby preventing the second side plate 62 of the shaft holding member 60 from being pressed and bent by the washer 67.

The elastic members 377 and 377 are provided at a contact portion or location at which the thermal head 3 and the head holding member 4 make contact with each other. Accordingly, the elastic members 377 and 377 absorb the vibration of the thermal head 3 during printing, thereby making is possible to prevent the occurrence or wear (abrasion) which would be otherwise caused due to the contact between the thermal head 3 and the head holding member 4.

The stepped screw 90, as the guide member, is fixed to the head holding member 4, and the shaft holding member 60 is formed with the long hole 65 into which the stepped screw 90 is insertable. Accordingly, the long hole 65 is guided with respect to the stepped screw 90 so as to allow the shaft holding member 60 to be movable between the engaging position and the non-engaging position.

In the embodiment, the front-rear direction is an example of the "first direction" of the present disclosure; the left-right direction is an example of the "second direction" of the present disclosure; the groove 42 is an example of the "first engaging part" or the "recessed part" of the present disclosure; the insertion part 64 is an example of the "second engaging part" of the present disclosure; the screw 80 is an example of the "fixing member" of the present disclosure; the washer 67 is an example of the "fixing member-holding member" of the present disclosure; and the stepped screw 90 is an example of the "guide member" of the present disclosure.

The printing apparatus of the present disclosure is not limited to or restricted by the embodiment as described above, and a variety of changes may be added to the embodiment in a range not departing from the gist and/or sprit of the present disclosure. For example, the following modifications may be added as appropriate. The washer 67 may be an E-type retaining ring (E-ring), etc. The shaft holding member 60 may be either a metal plate or a synthetic resin plate.

The configuration of the printing apparatus 1 may be changed as appropriate. The first direction, the second direction and the up-down direction of the printing apparatus 1 may be changed as appropriate. The first direction, the second direction and the up-down direction may cross with one another, and do not need to be orthogonal to one another. The printing apparatus 1 may be provided with a print medium conveying device configured to convey the print medium. The configurations of the print medium and the ink ribbon may be changed as appropriate. The driving source for driving the respective members may be changed as appropriate. The conveyance path of the ink ribbon in the printing apparatus 1 may be changed as appropriate. It is allowable that the printing apparatus 1 is not provided with all or a part of the constituent elements or components of the ribbon conveying mechanism 20. A device configured to convey the ink ribbon may be provided, separately from the printing apparatus 1. The printing apparatus may be provided with a platen. The platen may be a plate-shaped platen or a roller-shaped platen. It is allowable that the stand 2 is not a flat plate-shaped member. The base may be a member having convex and concave portions (irregularities) in a surface thereof, or may be a member having a curved surface. The base may be box-shaped.

It is allowable that the head holding member 4 is not provided with the rolling member 45. It is allowable that the rolling member 45 does not project beyond at least one of the upper surface 402 and the bottom surface (not depicted in the drawings). It is allowable that the thermal head 3 is not provided with the curved surface 378. The thermal head 3 may contact with the rolling member 45 in a plane. The arrangement of the plurality of heating elements 31 may be changed as appropriate; it is allowable that the plurality of heating elements 31 are not arranged along the edge part, of the thermal head, extending in the front-rear direction while being oriented toward the other side in the up-down direction, of the thermal head. It is allowable that the extending direction of a third line connecting the center in the left-right direction of the rolling member and the positions of the left-right direction of the plurality of heating elements is not coincident with the up-down direction. It is allowable that the external force applied to the thermal head includes a force different from the pressing force from the harness, or does not include the pressing force from the harness.

What is claimed is:

1. A printing apparatus comprising:

a thermal head including a plurality of heating elements arranged in a first direction;

a shaft provided on the thermal head, an axis line of the shaft extending in a second direction crossing the first direction;

a first engaging part provided on the shaft member;

a head holder configured to support the thermal head rotatably about the axis line of the shaft and detachably in the second direction;

an insertion part provided on the head holding member, the shaft member being insertable into the insertion part rotatably about the axis line and detachably in the second direction;

a shaft holder configured to hold the shaft;

a second engaging part provided on the shaft holder and configured to engage with the first engaging part so that the shaft is rotatable about the axis line and that the shaft does not come off from the shaft holder;

a guide configured to guide the shaft holder movably between an engaging position at which the first engaging part and the second engaging part engage with each other and a non-engaging position at which the first engaging part and the second engaging part do not engage with each other;

a fixing member configured to fix the shaft holder to the head holder in a case that the shaft holder is located at the engaging position; and a fixing member-holder configured to hold the fixing member so that the fixing member does not come off from the shaft holder in a case that the shaft holder is located at the non-engaging position.

2. The printing apparatus according to claim 1, wherein the first engaging part is a recessed part formed in a circumferential direction of the shaft, the second engaging part is an insertable part configured to be insertable into the recessed part, and in a case that the shaft holder is located at the engaging position, a gap is defined between the recessed part and the insertable part.

3. The printing apparatus according to claim 1, wherein the fixing member is provided with a head part, a cylindrical part extended from the head part, and a screw part formed in the cylindrical part at a location on an opposite side to the head part, the head holder is provided with an insertion hole into which the fixing member is insertable, and the insertion hole is provided with a hole having an inner diameter greater than a diameter of the screw part, and a screw hole formed on a side of an end portion of the hole and configured to be screwed to the screw part.

4. The printing apparatus according to claim 1, further comprising an elastic member provided at a contact position at which the thermal head and the head holder contact with each other.

5. The printing apparatus according to claim 1, wherein the guide is a stepped screw configured to be fixed to the head holder, a long hole into which the stepped screw is insertable is formed in the shaft holder, and the long hole is guided with respect to the stepped screw so as to allow the shaft holder to be movable between the engaging position and the non-engaging position.

* * * * *